US005467789A

United States Patent [19]

Takahashi et al.

[11] Patent Number: 5,467,789

[45] Date of Patent: Nov. 21, 1995

[54] SYSTEM FOR REMOVAL OF PHOSPHOR FROM CRT PANELS

[75] Inventors: Haruki Takahashi; Bill Lin, both of San Diego, Calif.

[73] Assignee: Sony Electronics Inc.

[21] Appl. No.: 185,544

[22] Filed: Jan. 24, 1994

[51] Int. Cl.[6] ..... B08B 3/02

[52] U.S. Cl. ..... 134/56 R; 134/58 R; 134/168 R; 134/167 R

[58] Field of Search ..... 132/56 R, 58 R, 132/178, 110, 167 R, 168 R; 234/101; 251/14

[56] References Cited

U.S. PATENT DOCUMENTS

| | | | |
|---|---|---|---|
| Re. 20,007 | 6/1936 | Hall, Jr. | 251/14 |
| 2,352,154 | 6/1944 | Trott | 251/14 X |
| 2,698,157 | 12/1954 | Ludemann | 251/14 |
| 2,698,602 | 1/1955 | Olcutt | 251/14 X |
| 4,206,900 | 6/1980 | Willis | 251/14 |
| 5,301,702 | 4/1994 | McKinney | 134/167 R |

FOREIGN PATENT DOCUMENTS 1552801 9/1979 United Kingdom .

*Primary Examiner*—Frankie L. Stinson

*Attorney, Agent, or Firm*—Pasquale Musacchio; Jerry A. Miller

[57] ABSTRACT

A system which enables removal of phosphor from a CRT front panel flange. The system includes an air operated valve connected between a water supply and a nozzle. The air operated valve may be incrementally opened and closed, which enables a continuous stream of water to be discharged from the nozzle onto the phosphor to remove the phosphor. In addition, the system includes an air supply and a pair of speed controllers which control the rate at which the air operated valve opens and closes.

6 Claims, 3 Drawing Sheets

SYSTEM FOR REMOVAL OF PHOSPHOR FROM CRT PANELS

FIELD OF THE INVENTION

This invention relates to the manufacture of cathode ray tubes (CRTs), and more particularly, to a system for removing excess phosphor from a CRT front panel.

BACKGROUND OF THE INVENTION

CRTs include an electron gun device and a phosphor structure both of which are held within an evacuated enclosure. Typically, the enclosure includes a front panel section having a panel inner surface which includes the phosphor structure. In addition, the front panel includes a peripheral flange having a flange inner surface located adjacent to the panel inner surface.

The phosphor structure is formed by depositing phosphor that is in fluid form onto the panel inner surface. Frequently, the fluidic properties of the phosphor cause spreading of phosphor past the panel inner surface to the adjacent flange inner surface. The presence of phosphor on the flange inner surface results in many undesirable effects such as tube arcing and others. Consequently, it is desirable that the excess phosphor be removed from the flange inner surface to avoid such undesirable effects.

In order to remove the excess phosphor, CRT assembly lines include water trimmer systems each having a nozzle arrangement for discharging a continuous stream of water onto the phosphor. In operation, a front panel in the assembly line is transported to a water trimmer station and positioned such that water from the nozzle arrangement is discharged onto the flange inner surface, thus removing substantially all of the excess phosphor. The panel is then transported away from the water trimmer station to enable placement of the next front panel in the assembly line in the water trimmer station. A stream of water is continually discharged from the nozzle in such systems, including during the time interval between movement of a front panel away from the water trimmer station and placement of the next front panel in the water trimmer station. This is a disadvantage since a substantial amount of water is not utilized and thus wasted during each workday, which undesirably increases production costs. In addition, this water usage unnecessarily depletes limited water resources and is generally harmful to the environment. Furthermore, these disadvantages are exacerbated in areas of the country which are drought prone, such as in southern California.

In order to reduce the amount of water that is used, a solenoid valve has been added to such trimmer systems to control water discharge from the nozzle. The solenoid valve may be actuated so that it is in one of two positions. In a first position, an internal passageway within the valve is fully open to allow maximum water discharge from the nozzle. In a second position, the internal passageway is fully closed to stop water discharge from the nozzle. Referring to FIG. 1, a water discharge curve 11 for a trimmer system having a solenoid valve is shown. In the closed position, the valve stops water discharge from the nozzle as indicated by the first 10 and second 12 sections on the curve 11. Alternatively, in the open position, the valve allows maximum water discharge from the nozzle as indicated by the third section 14 on the curve 11. As such, the valve functions as an on/off valve. The transition between no water discharge and maximum water discharge occurs relatively instantaneously, as indicated by the substantially vertical sections 16,18 of the curve 11.

In operation, the valve is initially in the closed position (i.e. the first section 10) wherein no water is discharged from the nozzle. A front panel in the assembly line is then placed in the water trimmer station. The valve is then actuated such that it is in the completely open position (i.e. third section 14) which causes a maximum discharge of water from the nozzle and enables the removal of excess phosphor. Upon removal of the excess phosphor, the valve is actuated in order to return it to the closed position (i.e. the second section 12) wherein the discharge of water from the nozzle is stopped, thus reducing water usage.

However, such systems have disadvantages. In particular, it has been found that the relatively instantaneous transition between no water discharge and maximum water discharge, as indicated by vertical sections 16,18, results in splashing of water onto both the flange and panel inner surfaces. This undesirably removes phosphor from the panel inner surface as well as the flange inner surface. The removal of phosphor from the panel inner surface results in an unacceptable front panel that does not meet quality standards. As such, the panel must be either repaired or discarded, which decreases production yields and increases costs. Consequently, there is a need in the art for a phosphor removal system which reduces water usage and which substantially reduces splashing.

SUMMARY OF THE INVENTION

A system for removing material from a surface by using a stream of water which is discharged onto said material. The system includes a water supply connected to a first valve by a first conduit and a nozzle connected to the first valve by a second conduit. The first valve may be incrementally opened at a rate which corresponds to an incoming air flow rate received by the first valve. This causes water from the water supply to flow through the first conduit, the first valve, the second conduit and the nozzle. The water is then discharged from the nozzle on the material at a water flow rate which incrementally increases from a zero water flow rate to a maximum water flow rate. In addition, the first valve may be incrementally closed at a rate which corresponds to an outgoing air flow rate vented by the first valve. This causes the water flow rate from the nozzle to incrementally decrease from the maximum water flow rate to a zero water flow rate such that the water discharged from the nozzle does not include air bubbles to provide a continuous stream of water.

Furthermore, the system includes an air flow device which serves to adjust the incoming air flow rate and the outgoing air flow rate, wherein the air flow device is connected to the first valve by a third conduit.

Additionally, the system includes an air supply for supplying the incoming air to the air flow device, wherein the air supply is connected to the air flow device by a fourth conduit.

DETAILED DESCRIPTION OF THE INVENTION

Figure 1:
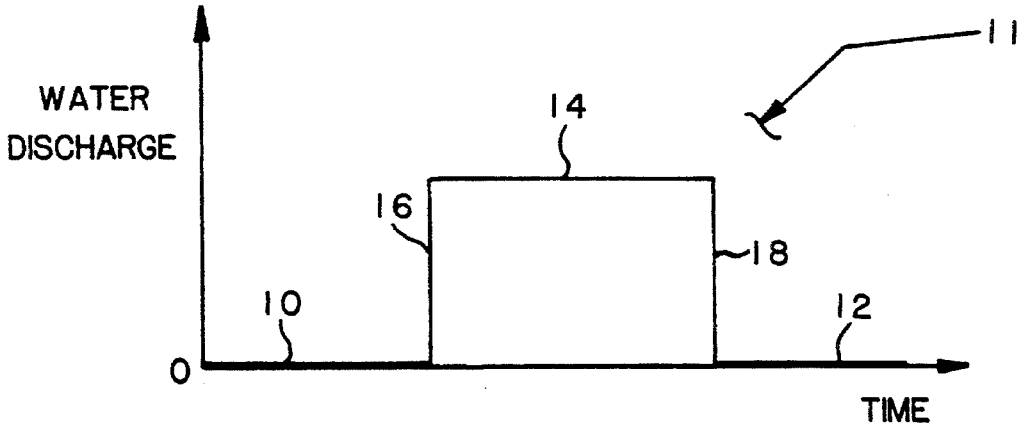
FIG. 1 illustrates a water discharge curve for a prior art water trimmer system having an on/off valve.

The present invention will now be described by referring to the following description in conjunction with FIGS. 2–5B wherein like elements are designated by like reference numerals. In addition, the present invention will be described in relation to water trimmer systems utilized for the removal of excess phosphor from a CRT front panel. However, it is noted that the present invention may also be utilized in other systems which also use a fluid stream to remove material from a structure surface.

Figure 2:
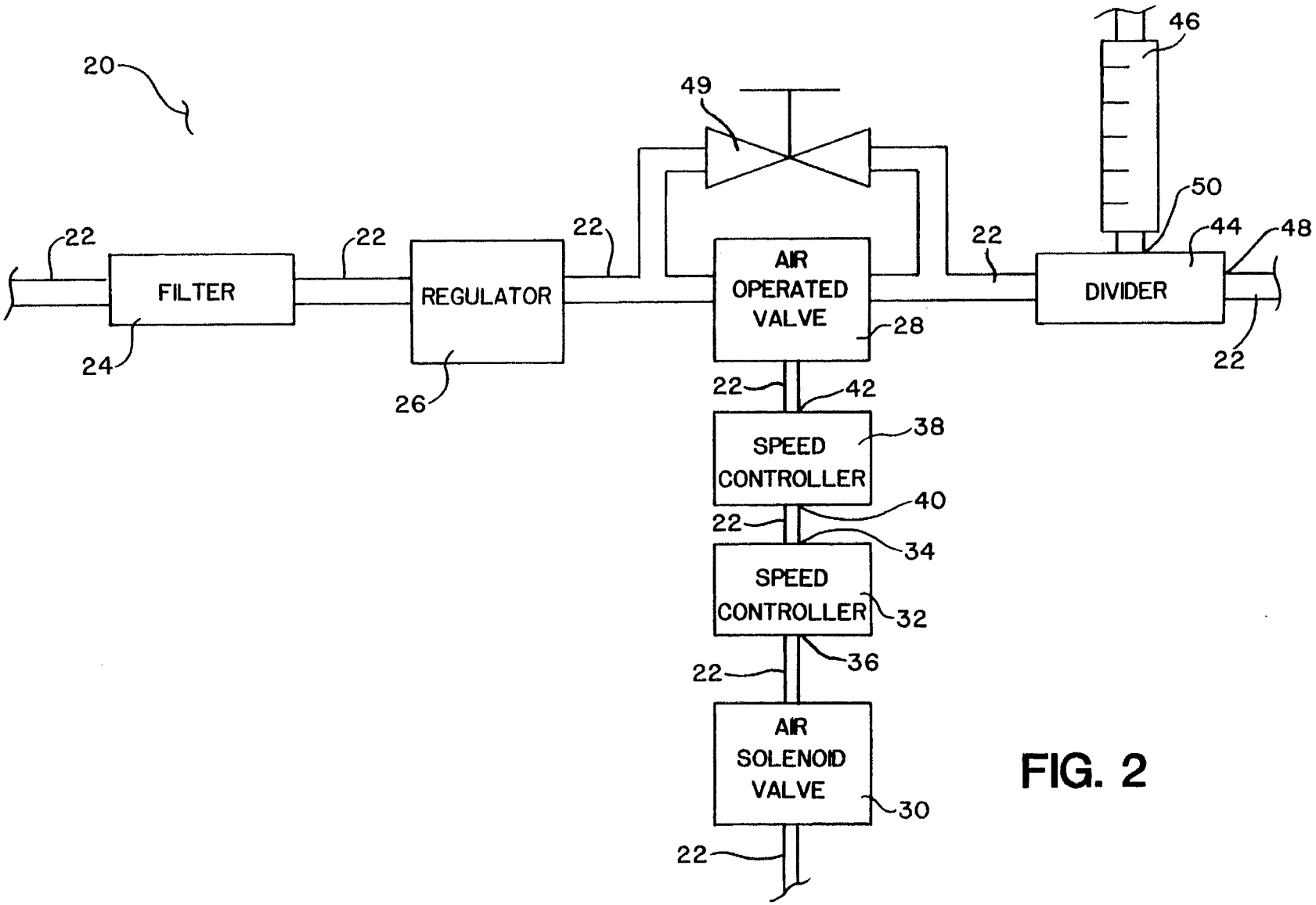
FIG. 2 is a block diagram illustrating a system for removing excess phosphor in accordance with the present invention.

Referring to FIG. 2, a system 20 in accordance with the present invention is shown. It is noted in the following description that the elements of the system 20 are connected by pipe sections 22. The system 20 includes a water filter 24 connected to a water supply (not shown). The water filter 24 sufficiently filters incoming water to ensure that the CRT front panel is not substantially contaminated with impurities.

The system 20 further includes a pressure regulator 26 connected between the water filter 24 and an air operated valve 28. The pressure regulator 26 ensures that water pressure in the system 20 does not exceed predetermined design limits. The air operated valve 28 regulates a water flow rate supplied to nozzles as will be described. The air operated valve 28 includes an internal passageway (not shown) which may be incrementally opened or closed. This enables correspondingly incremental changes in the water flow rate through the air operated valve 28 between a maximum water flow (open position) and no water flow (closed position), respectively. The air operated valve 28 is incrementally opened by introducing air flowing at a predetermined air flow rate into the air operated 28. The air operated valve 28 may then be incrementally closed by exhausting air at a predetermined air flow rate from the air operated valve. The rate at which the air operated valve 28 is incrementally opened may be increased or decreased by correspondingly increasing or decreasing the air flow rate entering the air operated valve 28. Similarly, the rate at which the air operated valve 28 is closed may be increased or decreased by correspondingly increasing or decreasing the air flow rate for air exhausted from the air operated valve 28.

In addition, the system 20 includes an air solenoid valve 30, a first speed controller 32 having a first inlet end 34 and a first outlet end 36 and a second speed controller 38 having a second inlet end 40 and a second outlet end 42. The air solenoid valve 30 is connected between an air supply (not shown) and the first outlet end 36. The air solenoid valve 30 may be actuated so that it is in one of two positions. In a first position, an internal passageway (not shown) within the air solenoid valve 30 is fully open to allow air to flow from the air supply and enter the first outlet end 36. In a second position, the internal passageway is fully closed to stop air flow to the first outlet end 36. As such, the air solenoid valve 30 functions as an on/off valve.

The first inlet end 34 of the first speed controller 32 is connected to the second inlet end 40 of the second speed controller 38. Additionally, the second outlet end 42 is connected to the air operated valve 28. The first 32 and second 38 speed controllers serve to control an air flow rate. As such, air which enters the first 34 and second 40 inlet ends exits the first 36 and second 42 outlet ends having first and second air flow rates, respectively. Furthermore, the first 32 and second 38 speed controllers are independently adjustable to enable adjustment of the first and second air flow rates as desired.

In addition, the first 32 and second 38 controllers each include a check valve (not shown). Each check valve allows unrestricted air flow through the first 32 and second 38 speed controllers for air which enters into the first 36 and second outlet 42 ends and exits from the first 34 and second 40 inlet ends. The air operated valve, air solenoid valve and speed controllers are generally commercially available products. By way of example, SMC Corporation in Tokyo, Japan manufactures an air operated valve designated as Model No. VLA11-02-S or F, an air solenoid valve designated as Model No. VFS2110-5DZB-02 and a speed controller designated as Model No. AS 1000.

As such, the first 32 and second 38 speed controllers are arranged such that the air flow rate for incoming air received by the first outlet end 36 is unrestricted by the first speed controller 32. The incoming air then enters the second speed controller 38 and exits having a desired second air flow rate before entering the air operated valve 28. This causes the air operated valve 28 to incrementally open at a rate corresponding to the second air flow rate.

Conversely, air which is exhausted from the air operated valve 28 and enters into the second outlet end 42 is unrestricted by the second speed controller 38. This air then enters the first speed controller 32 and exits having a desired first air flow rate. This causes the air operated valve 28 to incrementally close at a rate corresponding to the first air flow rate.

The system 20 also includes a flow divider 44 having first 48 and second 50 outlet ports. The flow divider 44 is connected to the air operated valve 28 and receives water flow which passes through the air operated valve 28 as the air operated valve 28 is incrementally opened and closed. The flow divider 44 serves to divide the water flow into first and second water flow components which are then discharged from the first 48 and second 50 outlet ports, respectively. The first 48 and second 50 outlet ports are each ultimately connected to a nozzle (not shown). As will be described, each nozzle discharges a continuous stream of water. In addition, a flow meter 46 (only one is shown in FIG. 2) is connected between the first and second outlet ports and each nozzle. Each flow meter serves to indicate the flow rate of water supplied to the nozzle.

In addition, a bypass valve 49 is connected in parallel to the air operated valve 28. The bypass valve 49 functions as an on/off valve and may be turned on or off by an operator as desired. When the bypass valve 49 is turned on, the water flow is diverted around the air operated valve 28 such that it flows directly to the flow divider 44 and ultimately to each nozzle without restriction. When the bypass valve 49 is turned off, the water flow is directed to the air operated valve 28 as previously described. The bypass valve 49 is used to perform various tests and to set operating parameters for the system 20.

Figure 3:
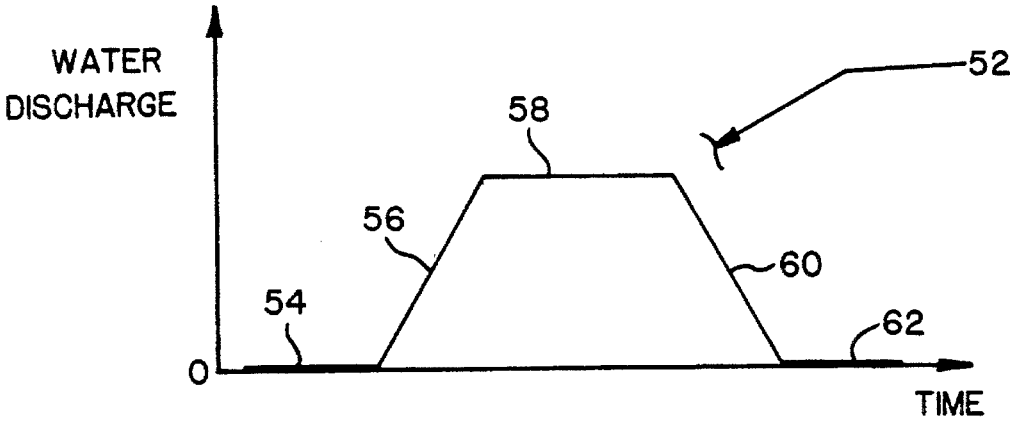
FIG. 3 illustrates a water discharge curve in accordance with the present invention.

Referring to FIG. 3, a water discharge curve 52 for a typical nozzle (not shown) is illustrated. FIG. 3 will be described in conjunction with FIG. 2. When the air solenoid valve 30 is closed, the air operated valve 28 is also closed, and no water is discharged from the nozzle as indicated by the first horizontal section 54 of the curve 52. When the air solenoid 30 is opened, incoming air flows into the first outlet end 36 and out of the first inlet end 34 of the first speed controller 32 without being restricted. Subsequently, the incoming air flows into the second inlet end 40 and exits from second outlet end 42 having a second air flow rate. The incoming air then enters the air operated valve 28, thus causing incremental opening of the air operated valve 28 at a rate corresponding to the air flow rate of the incoming air. This allows an increasing amount of water to flow through the air operated valve 28 and thus discharged through the nozzle as indicated by the upwardly sloping section 56 of the curve 52. When the air operated valve 28 is fully opened, the water discharge reaches a maximum as indicated by the second horizontal section 58 of the curve 52. The air operated valve 28 is then maintained open for a predetermined time period sufficient to remove excess phosphor from the flange inner surface as will be described.

Upon closing of the air solenoid valve 30, air is exhausted from the air operated valve 28. The exhausted air then flows into the second outlet end 42 and out of the second inlet end 40 of the second speed controller 38 without being restricted. Subsequently, the exhausted air flows into the first inlet end 34 and exits from the first outlet end 36 having a first air flow rate. This causes incremental closing of the air operated valve 28, thus allowing a decreasing amount of water to flow through the air operated valve 28 and thus discharged through the nozzle as indicated by the downwardly sloping section 60 of the curve 52. When the air operated valve 28 is completely closed, no water is discharged from the nozzle as indicated by the third horizontal section 62 of the curve 52.

CRT assembly lines include water trimmer systems each having a nozzle arrangement for discharging a continuous stream of water onto the phosphor. In operation, a front panel in the assembly line is transported to a water trimmer station and positioned such that water from the nozzle arrangement is discharged onto the flange inner surface, thus removing substantially all of the excess phosphor. The panel is then transported away from the water trimmer station to enable placement of the next front panel in the assembly line in the water trimmer station. A stream of water is continually discharged from the nozzle in such systems, including during the time interval between movement a front panel away from the water trimmer station and placement of the next front panel in the water trimmer station. This is a disadvantage since a substantial amount of water is not utilized and thus wasted during each workday, which undesirably increases production costs.

Typically, a nozzle discharges 0.6 liters of water per minute. In addition, a total of 84 nozzles may be used in two assembly lines. As such, the total water usage per day for both assembly lines is approximately 72,576 liters. In addition, the indexing time for a single front panel is approximately 23 seconds. Through implementation of the present invention, water is not discharged for approximately 8.5 seconds out of the 23 second indexing time. As such, water usage is reduced by approximately 37%. Therefore, the present invention reduces the amount of liters of water used per day for both assembly lines by 37% or 26,853 liters. Over a year, (300 workdays) this results in a substantial water savings of approximately 8,055,936 liters or 2,128,153 gallons for both assembly lines.

It has been found that water trimmer systems which utilize an on/off valve for reducing water usage generate air bubbles in the system. The air bubbles cause disruptions in the stream of water discharged from the nozzle and results in a non-continuous flow of water. This causes splashing of water onto both flange and panel inner surfaces of a CRT and the undesirable removal of phosphor from the panel inner surface. The removal of phosphor results in an unacceptable front panel that must be repaired or discarded. It has been found that the incremental opening and closing of the air operated valve 28 results in a substantial reduction of air bubbles. As a result, a continuous flow of water is discharged from the nozzle, which substantially reduces water splashing. Through implementation of the present invention, it has been found that the occurrence of panels that are damaged due to splashing has been reduced by approximately 41%.

Figure 4:
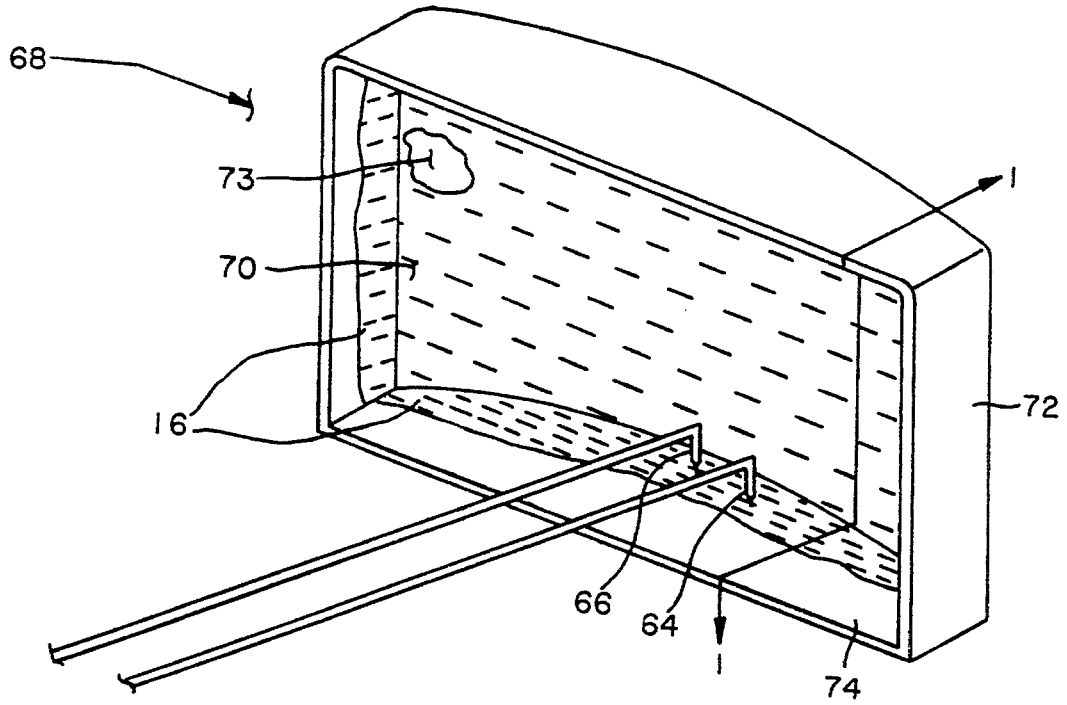
FIG. 4 depicts a CRT front panel and nozzle arrangement.

Referring to FIG. 4 in conjunction with FIG. 2, first 64 and second 66 nozzles of the system 20 and a CRT front panel 68 are shown. The first 64 and second 66 nozzles are connected to the first 48 and second 50 outlet ports of the flow divider 44, respectively. The front panel 68 includes a panel inner surface 73 (shown as a partial view) having a phosphor structure 70 formed thereon. In addition, the front panel 68 includes a peripheral flange 72 having a flange inner surface 74. The flange inner surface 74 is positioned adjacent to the panel inner surface 73.

The phosphor structure 70 is formed by depositing phosphor that is in fluid form onto the panel inner surface 73. Frequently, the fluidic properties of the phosphor result in spreading of the phosphor past the panel inner surface 73. However, the spreading of phosphor on the flange inner surface 74 results in many undesirable effects such as tube arcing and others. Consequently, the removal of the excess phosphor 76 from the flange inner surface 74 is desirable in order to avoid such undesirable effects.

Figure 5A:
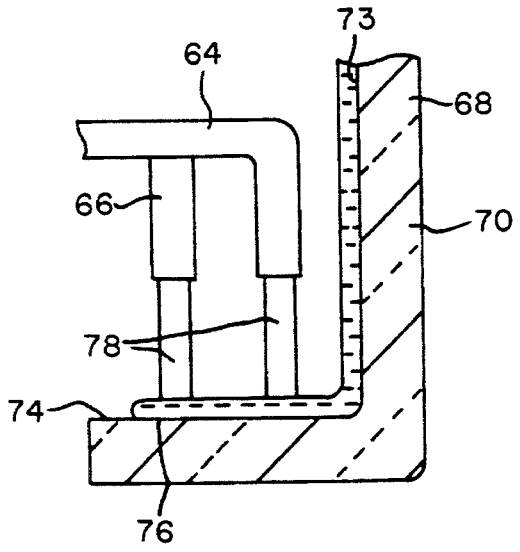
FIGS. 5A–5B are partial cross sectional views of the CRT front panel along section line 1—1 of FIG. 4.
Figure 5B:
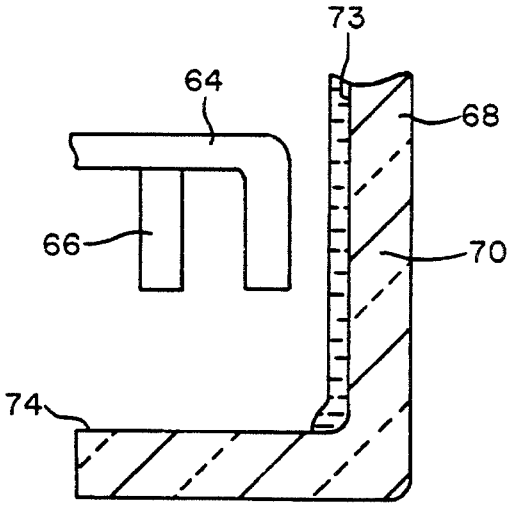

FIGS. 5A and 5B are partial cross sectional views of the front panel 68 and the first 64 and second 66 nozzles along section line 1—1 of FIG. 4. Referring to FIG. 5A, the first 64 and second 66 nozzles are positioned in a staggered configuration. This enables water 78 from each nozzle to be discharged directly onto the excess phosphor 76 located on a portion of the flange inner surface 74, thus washing away and removing the excess phosphor 76. Referring to FIG. 5B, the front panel 68 is shown after the excess phosphor 76 shown in FIG. 5A has been removed. In accordance with the present invention, air bubbles are substantially reduced, thus substantially eliminating splashing of water and enabling removal of the excess phosphor 76 on the flange inner surface 74 without also removing phosphor 70 from the panel inner surface 73.

The front panel 68 is placed in a rotatable holding fixture (not shown) which rotates the front panel 68 about the first 64 and second 66 nozzles. This allows water to be discharged directly onto the entire flange inner surface 74 which thus removes substantially all of the excess phosphor 76 located thereon. Consequently, the possibility of tube arcing and other undesirable effects which occur due to the presence of excess phosphor 76 on the flange inner surface 74 is substantially reduced.

Thus it is apparent that the present invention satisfies the objectives, aim and advantages set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A system for removing material from a surface by using a stream of water which is discharged onto said material comprising:

a water supply connected to a first valve by a first conduit;

a nozzle connected to said first valve by a second conduit, wherein said first valve may be incrementally opened at a rate which corresponds to an incoming air flow rate received by said first valve, such that water from said water supply flows through said first conduit, said first valve, said second conduit and said nozzle and is discharged from said nozzle on said material at a water flow rate which incrementally increases from a zero water flow rate to a maximum water flow rate, and wherein said first valve may be incrementally closed at a rate which corresponds to an outgoing air flow rate vented by said first valve, such that said water flow rate from said nozzle incrementally decreases from said maximum water flow rate to said zero water flow rate and wherein said water discharged from said nozzle does not include air bubbles to provide a continuous stream of water;

air flow means for adjusting said incoming air flow rate and said outgoing air flow rate, wherein said air flow means is connected to said first valve by a third conduit and wherein said air flow means includes first and second speed controllers arranged such that said incoming air flow rate is not restricted by said first speed controller and is subsequently adjusted by said second speed controller and said outgoing air flow rate is not restricted by said second speed controller and is subsequently adjusted by said first speed controller; and an air supply for supplying said incoming air to said air flow means, wherein said air supply is connected to said air flow means by a fourth conduit.

2. The system according to claim 1, wherein said material is phosphor and said surface is a CRT front panel inner flange.

3. The system according to claim 1, further including a water filter connected between said water supply and said first valve.

4. The system according to claim 1, further including a pressure regulator connected between said water supply and said first valve.

5. The system according to claim 1, further including a bypass valve connected in parallel to said first valve to enable said water to bypass said first valve.

6. A system for removing phosphor from a CRT panel flange inner surface by using a stream of water that is discharged onto said phosphor, comprising:

a water supply connected to a first valve by a first conduit;

a nozzle connected to said first valve by a second conduit, wherein said first valve may be incrementally opened at a rate which corresponds to an incoming air flow rate received by said first valve, such that water from said water supply flows through said first conduit, said first valve, said second conduit and said nozzle and is discharged from said nozzle onto said phosphor at a water flow rate which incrementally increases from a zero water flow rate to a maximum water flow rate, and wherein said first valve may be incrementally closed at a rate which corresponds to an outgoing air flow rate vented by said first valve, such that said water flow rate from said nozzle incrementally decreases from said maximum water flow rate to said zero water flow rate and wherein said water discharged from said nozzle does not includes air bubbles to provide a continuous stream of water;

air flow means for adjusting said incoming air flow rate and said outgoing air flow rate, wherein said air flow means is connected to said first valve by a third conduit and includes first and second speed controllers arranged such that said incoming air flow rate is not restricted by said first speed controller and is subsequently adjusted by said second speed controller and said outgoing air flow rate is not restricted by said second speed controller and is subsequently adjusted by said first speed controller;

an air supply for supplying said incoming air to said air flow means, wherein said air supply is connected to said air flow means by a fourth conduit;

an air solenoid connected between said air supply and said air flow means, wherein when said air solenoid valve is opened, said air supply supplies said incoming air to said air flow means and when said air solenoid valve is closed, said incoming air is not supplied to said air flow means thus causing said first valve to vent said outgoing air;

a water filter connected between said water supply and said first valve;

a pressure regulator connected between said water supply and said first valve; and a bypass valve connected in parallel to said first valve to enable said water to bypass said first valve.

* * * * *